US007019451B2

(12) United States Patent
Kang

(10) Patent No.: US 7,019,451 B2
(45) Date of Patent: Mar. 28, 2006

(54) SHADOW MASK OF COLOR CRT

(75) Inventor: Su-Dong Kang, Gumi (KR)

(73) Assignee: LG. Philips Displays Co., Ltd., Gumi (KR)

( * ) Notice: Subject to any disclaimer, the term of this patent is extended or adjusted under 35 U.S.C. 154(b) by 100 days.

(21) Appl. No.: 10/374,050

(22) Filed: Feb. 27, 2003

(65) Prior Publication Data

US 2004/0104661 A1 Jun. 3, 2004

(30) Foreign Application Priority Data

Nov. 29, 2002 (KR) ..... 10-2002-0075275
Jan. 3, 2003 (KR) ..... 10-2003-0000196

(51) Int. Cl.
*H01J 29/07* (2006.01)
*H01J 29/81* (2006.01)

(52) U.S. Cl. ..... 313/402; 313/408

(58) Field of Classification Search ..... 313/402, 313/408, 403–407
See application file for complete search history.

(56) References Cited

U.S. PATENT DOCUMENTS 5,689,149 A * 11/1997 Welles et al. ..... 313/402
6,157,119 A * 12/2000 Hung et al. ..... 313/402
6,285,122 B1 * 9/2001 Hosotani ..... 313/461
6,342,759 B1 * 1/2002 Hosotani ..... 313/463
6,486,596 B1 * 11/2002 Inoue et al. ..... 313/402
6,570,310 B1 * 5/2003 Aibara ..... 313/403
6,642,642 B1 * 11/2003 Watanabe et al. ..... 313/402

* cited by examiner

*Primary Examiner*—Karabi Guharay
*Assistant Examiner*—German Colón
(74) *Attorney, Agent, or Firm*—Birch, Stewart, Kolasch & Birch, LLP

(57) ABSTRACT

The color cathode-ray tube includes a panel having a fluorescent screen formed on the inner surface thereof, a funnel coupled to the panel, an electron gun mounted into the neck portion of the funnel for emitting electron beams toward the fluorescent screen, and a shadow mask mounted on the fluorescent screen formed on the inner surface of the panel and having a predetermined distance from the fluorescent screen for carrying out color selection. The shadow mask is in a rectangular shape having a longer axis and a shorter axis and including a plurality of beam through apertures. The vertical pitch of the beam through apertures is between 0.15 mm and 0.35 mm. The vertical pitch of the beam through apertures increases as it goes from the central portion to the end portion of the shorter axis of the shadow mask.

30 Claims, 4 Drawing Sheets

SHADOW MASK OF COLOR CRT

BACKGROUND OF THE INVENTION

1. Field of the Invention

The present invention relates to a shadow mask having a vertical pitch that simultaneously satisfies moire characteristic and purity characteristic, as distinguished from a conventional shadow mask having a vertical pitch that is equal in the shorter axis direction thereof but decreases as it goes along the longer axis direction thereof for tilt array design.

2. Background of the Related Art

Referring to FIG. 1, a conventional color cathode-ray tube (CRT) includes a panel 1 having a fluorescent screen 4 with R, G, B colors coated on the inner surface thereof and an explosion-proof glass fixed to the front portion thereof, a funnel 2 coupled to the rear panel 1, and an electron gun inserted in the neck portion of the funnel 2 for emitting electron beams 6. The color CRT further includes a deflection yoke for deflecting the electron beams, a shadow mask 3 that is mounted on the inner side of the panel at a predetermined distance therefrom and has a plurality of apertures through which the electron beams pass, and a frame 7 for fixing and supporting the shadow mask so as to maintain the predetermined distance between the shadow mask and the inner surface of the panel. The color CRT also has a spring 8, an inner shield 9 for shielding the earth-magnetic field so as to prevent the CRT from being affected by the earth-magnetic field, and a reinforcing band 11 mounted to surround the side of the panel for protecting the CRT from eternal shock. In addition, the conventional color CRT includes a magnet 10 for correcting the electron beam path so as to allow the electron beams to accurately hit predetermined phosphors, thereby preventing poor color purity.

FIG. 2 illustrates the structure of the conventional shadow mask. In FIG. 2, PVo denotes a vertical pitch between neighboring beams through apertures formed at the central portion of the shadow mask and PVc denotes a vertical pitch between adjacent beams through apertures placed at the corner portion of the shadow mask. Furthermore, PVe denotes a vertical pitch between neighboring beams through apertures formed at the end portion of the longer axis of the shadow mask, and PVt denotes a vertical pitch between adjacent beams through apertures placed at the end portion of the shorter axis of the shadow mask. PVo, PVc, PVe and PVt of the conventional shadow mask have the same value or have a difference of 1~3% approximately.

The conventional fluorescent screen 4 is formed of R, G, B phosphors formed on the rear side thereof and arranged in a pattern of a plurality of stripes or dots and a light absorption material such as a black coating 41 formed between neighboring phosphors. An aluminum thin film 42 as a conductive layer is formed on the rear side 12 to improve the luminance of the fluorescent screen 4, to protect the fluorescent screen 4 from being ion-damaged and to prevent the fall of potential of the fluorescent screen 4.

As for the phosphors R, G and B coated on the screen, as shown in FIG. 4, the distance between G and G (or R and R) in the longer axis direction is called a horizontal pitch SP of the fluorescent screen 4 and the distance between G and G (or R and R) in the shorter axis direction is called a vertical pitch SW thereof.

The vertical pitch PV of the shadow mask 3 has a close relationship with the moire characteristic, an important characteristic of the CRT, and affects the purity characteristic and rigidity of the shadow mask 3.

The main factors in the generation of the moire phenomenon in the a CRT includes the factor affecting the moiré wavelength and the factor affecting the moire intensity. The factor affecting the moiré wavelength includes a scanning line interval of electron beams and the vertical pitch of the shadow mask. The spot size of the electron gun affects the moire intensity. The moiré wavelength is calculated through the following expression.

$$\lambda = \frac{1}{\frac{1}{PV} - \frac{N}{2S}} \quad [\text{mm}]$$

In this expression, S denotes the electron beam scanning line interval, PV denotes the vertical pitch of the beam through apertures and N is an integer.

The moire intensity is calculated through the following expression $$M = k(PV) \times e^{-\frac{AD^2N^2}{S^2}}$$

In this expression, k(PV) denotes a constant determined by PV, A denotes a proportional constant and D is the spot size of the electron beam.

Since moire is the most noticeable when the moire wavelength is 4 mm~10 mm, the vertical pitch of the beam through apertures should be determined such that the moire wavelength is not in this range. In addition, the higher the moire intensity, the more pronounced the moire phenomenon. Thus, a smaller moire intensity value is preferable.

In case of the CRT, the scanning line interval depends on modes (640×480, 800×600, 1024×768, 1280×1024). Because a variation rate of the vertical pitch of the outer portion of the conventional shadow mask to that of the central portion thereof is as small as 1%~3%, it is impossible to control the vertical pitch so as to make the moire wavelength less than 4 mm by modes.

Furthermore, occurrence of the moire phenomenon can be prevented only when the vertical pitch is controlled according to the electron beam spot size because the spot size depends on positions as shown in the above expression for calculating the moire intensity. However, this is impossible with the conventional vertical pitch variation rate.

Moreover, in the relationship among the moire characteristic, purity characteristic and shadow mask vertical pitch, the smaller the vertical pitch, the better the moire characteristic. And, the larger the vertical pitch, the better the purity characteristic.

In Korean Patent No. 97-3365, the vertical pitch of the shadow mask increases as it goes from the central portion to the end portion of the shorter axis of the shadow mask but decreases as it goes from the center to the end portion of the longer axis of the shadow mask. In Korean Patent No. 99-27074, the shadow mask vertical pitch increases as it goes from the central portion to the skirt portion of the shadow mask. However, the conventional vertical pitches were designed, giving the first consideration to the moire characteristic, so that the purity characteristic became a problem.

SUMMARY OF THE INVENTION

Accordingly, the present invention is directed to a shadow mask of a color CRT that substantially obviates one or more problems due to limitations and disadvantages of the related art.

An object of the present invention is to provide a shadow mask design that simultaneously satisfies the moire characteristic and purity characteristic.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To accomplish the object of the present invention, there is provided a color cathode-ray tube including a panel having a fluorescent screen formed on the inner surface thereof, a funnel coupled to the panel, an electron gun mounted into the neck portion of the funnel for emitting electron beams toward the fluorescent screen, and a shadow mask mounted on the fluorescent screen formed on the inner surface of the panel, having a predetermined distance from the fluorescent screen for carrying out color selection, wherein the shadow mask is a roughly rectangular shape having a longer axis and a shorter axis and including a plurality of beam through apertures, the vertical pitch of the beam through apertures being between 0.15 mm and 0.35 mm; and the vertical pitch of the beam through apertures increases as it goes from the central portion to the end portion of the shorter axis of the shadow mask.

As a second technical measure to accomplish the object of the invention, there is provided a color cathode-ray tube including a panel having a fluorescent screen formed on the inner surface thereof, a funnel coupled to the panel, an electron gun mounted into the neck portion of the funnel for emitting electron beams toward the fluorescent screen, and a shadow mask mounted on the fluorescent screen formed on the inner surface of the panel and having a predetermined distance from the fluorescent screen for carrying out color selection, wherein the shadow mask is a roughly rectangular shape having a longer axis and a shorter axis and including a plurality of beam through apertures, the vertical pitch of the beam through apertures being between 0.15 mm and 0.35 mm; and the vertical pitch of the beam through apertures increases as it goes along the diagonal direction from the central portion to the corner portion of the shadow mask.

As a third technical measure to achieve the object of the present invention, there is provided a color cathode-ray tube including a panel having a fluorescent screen formed on the inner surface thereof, a funnel coupled to the panel, an electron gun mounted into the neck portion of the funnel for emitting electron beams toward the fluorescent screen, and a shadow mask mounted on the fluorescent screen formed on the inner surface of the panel and having a predetermined distance from the fluorescent screen for carrying out color selection, wherein the shadow mask is a roughly rectangular shape having a longer axis and a shorter axis and including a plurality of beam through apertures, the vertical pitch of the beam through apertures being between 0.15 mm and 0.35 mm; and the vertical pitch of the beam through apertures formed at the central portion of the shadow mask is smaller than the vertical pitch of the beam through apertures formed at the end portion of the shorter axis of the shadow mask, the vertical pitch of the beam through apertures formed at the central portion of the shadow mask being smaller the vertical pitch of the beam through apertures formed at the corner portion of the shadow mask.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
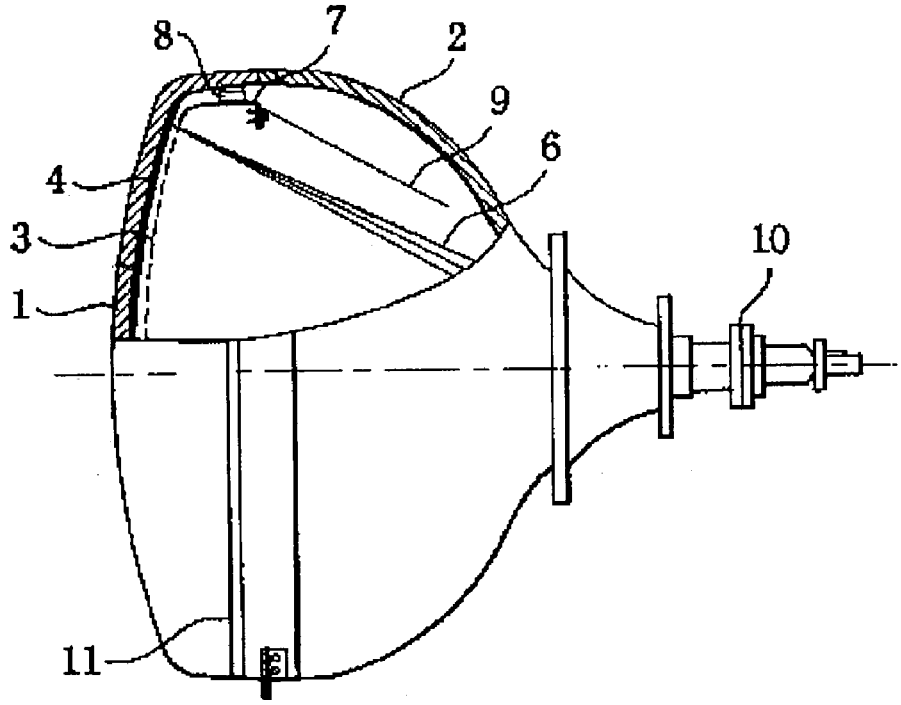
FIG. 1 is a cross-sectional view of a conventional color CRT.
Figure 2:
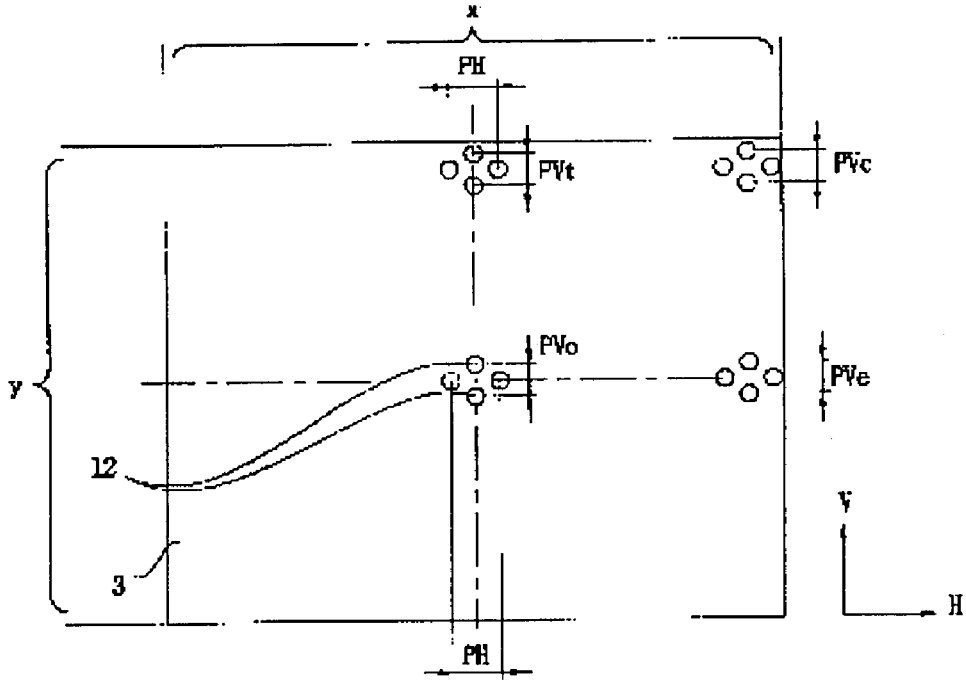
FIG. 2 illustrates vertical pitches between beam through apertures of a shadow mask.
Figure 3:
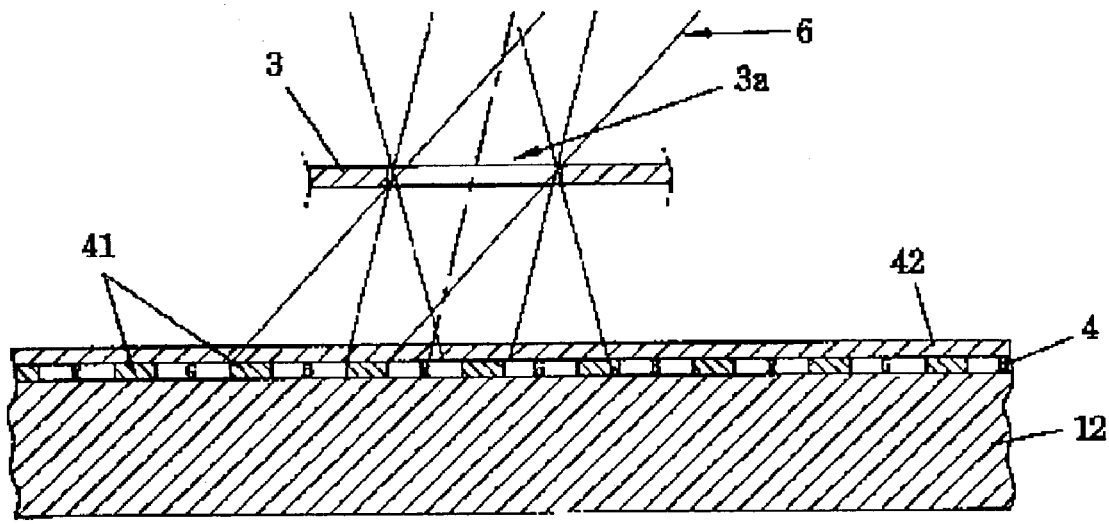
FIG. 3 illustrates beam through apertures and a fluorescent screen of the shadow mask.
Figure 4:
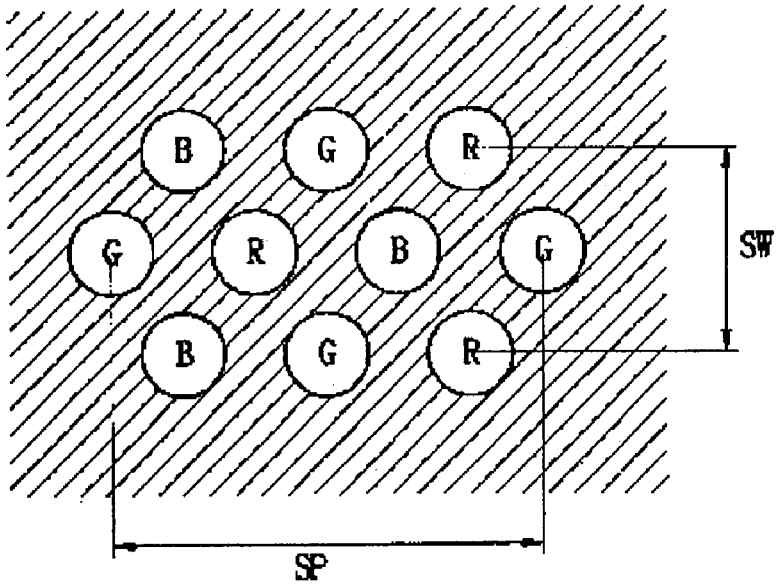
FIG. 4 illustrates vertical and horizontal pitches of the fluorescent screen.

As shown in FIG. 2, the shadow mask 3 generally has a rectangular form having two horizontal longer-axis sides x and two vertical shorter-axis sides y. The two horizontal longer-axis sides and two vertical shorter-axis sides are also called longer sides and shorter sides, respectively. The longer sides x are parallel with the central longer axis of the shadow mask and the shorter sides y are parallel with its shorter axis.

Furthermore, the shadow mask 3 has beam through apertures 3*a* arranged in vertical rows and horizontal columns. A beam through aperture 3*a* in a column and a beam through aperture in a neighboring column are placed in different rows. The vertical distance between neighboring beam through apertures in the same row is the vertical pitch PV of the beam through apertures and the horizontal distance between adjacent beam through apertures in the same row is the horizontal pitch PH of the beam through apertures.

The vertical pitch PVo between neighboring beam through apertures formed at the central portion of the shadow mask according to the present invention is between 0.15 mm and 0.35 mm and increases as it goes from the central portion to the end portion of the shorter axis of the shadow mask.

TABLE 1

| | Vertical pitch of shadow mask of CRT for 19" monitor according to the present invention | | | | | | | | |
|---|---|---|---|---|---|---|---|---|---|
| Y/X (mm) | 0.00 | 30.00 | 60.00 | 90.00 | 120.00 | 150.00 | 170.00 | 177.35 | 180.00 |
| 0.00 | 0.260 | 0.260 | 0.259 | 0.259 | 0.258 | 0.257 | 0.256 | 0.255 | 0.255 |
| 25.00 | 0.260 | 0.260 | 0.260 | 0.259 | 0.258 | 0.257 | 0.256 | 0.256 | 0.255 |
| 50.00 | 0.262 | 0.262 | 0.261 | 0.261 | 0.260 | 0.259 | 0.258 | 0.257 | 0.257 |
| 75.00 | 0.264 | 0.264 | 0.264 | 0.263 | 0.262 | 0.261 | 0.260 | 0.260 | 0.260 |
| 100.00 | 0.268 | 0.268 | 0.267 | 0.267 | 0.266 | 0.265 | 0.264 | 0.264 | 0.263 |
| 125.00 | 0.274 | 0.274 | 0.274 | 0.274 | 0.272 | 0.271 | 0.271 | 0.270 | 0.270 |
| 133.15 | 0.276 | 0.276 | 0.276 | 0.275 | 0.274 | 0.273 | 0.272 | 0.272 | 0.272 |
| 135.00 | 0.276 | 0.276 | 0.276 | 0.275 | 0.275 | 0.274 | 0.273 | 0.272 | 0.272 |

The above table 1 shows the vertical pitch of the shadow mask of a CRT for a high-resolution 19" monitor according to an embodiment of the present invention. The vertical pitch between beam through apertures of the central portion of the shadow mask is 0.2 mm~0.3 mm.

Figure 5:
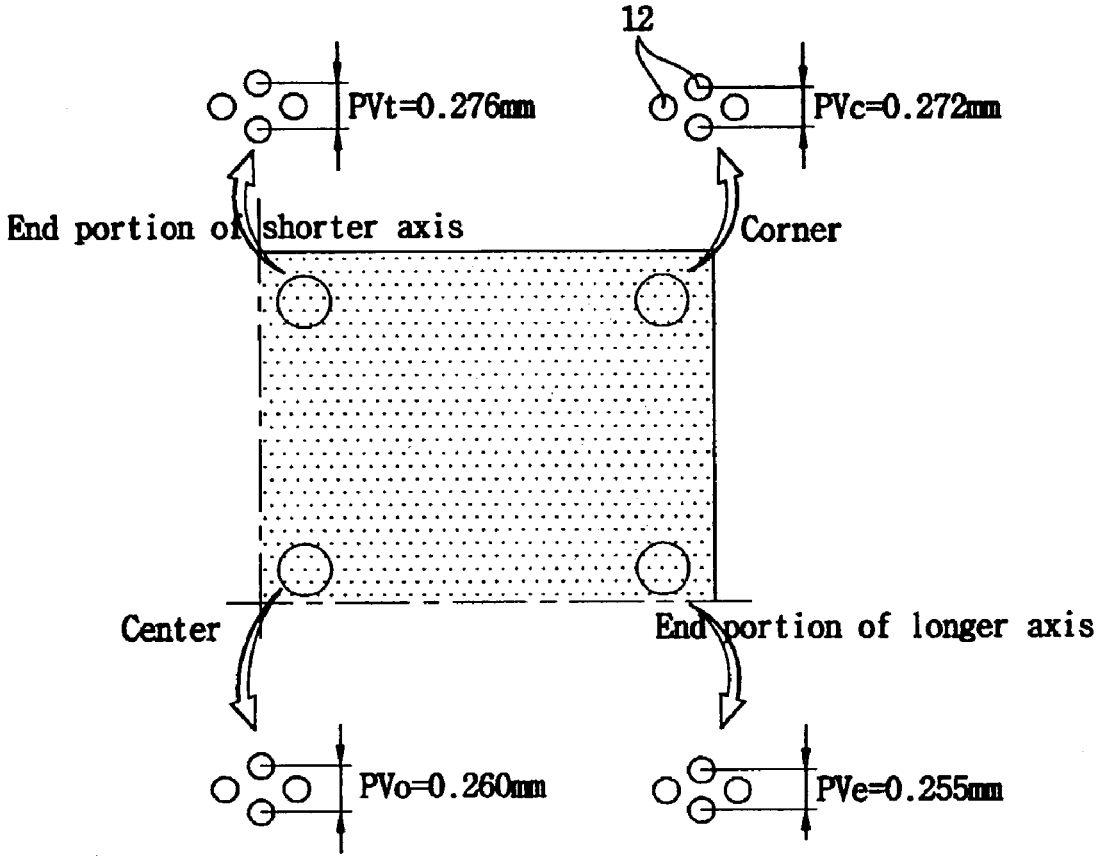
FIG. 5 illustrates an embodiment of a shadow mask structure according to the present invention.
Figure 6:
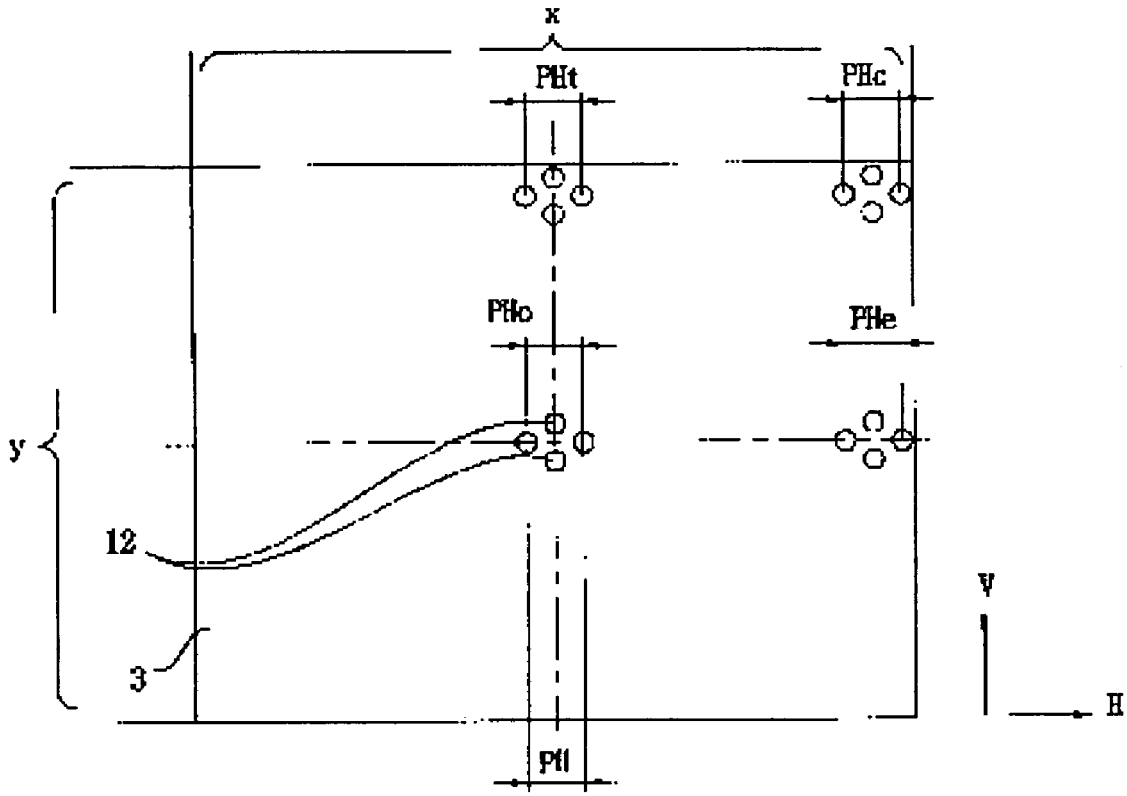
FIG. 6 illustrates a horizontal pitch between beam through apertures of the shadow mask of the invention.

Referring to FIG. 5, the shadow mask of the present invention is designed in a manner that the vertical pitch PVt of beam through apertures 3*a* increases 4%~12% of the beam through aperture vertical pitch PVo of the central portion of the shadow mask as it goes from the central portion to the end portion of the shorter axis of the shadow mask, and the vertical pitch PVc increases 3%~10%of the vertical pitch of the central portion thereof as it goes from the central portion to the corner portion of the shadow mask.

Accordingly, when the vertical pitch of the beam through apertures formed on the central portion of the shadow mask is called PVo, the vertical pitch of the beam through apertures placed at the end portion of the shorter axis thereof is called PVt, and the vertical pitch of the beam through apertures formed at the corner portion thereof is called PVc, the following expressions (1) and (2) are satisfied.

$$1.04PVo \leqq PVt \leqq 1.12PVo \quad (1)$$

$$1.03PVo \leqq PVc \leqq 1.1PVo \quad (2)$$

In addition, the vertical pitch PVo of the beam through apertures of the central portion of the shadow mask is identical to or larger than 0.2 mm and identical to or smaller than 0.3 mm. If the vertical pitch PVo of the central portion of the shadow mask is smaller than 0.2 mm, a space between neighboring apertures of the shadow mask becomes too small. This causes clogging of the mask and increases possibility of generation of poor color mixture. Furthermore, purity margin becomes considerably small to result in deterioration in ITC productivity. When the vertical pitch PVo is larger than 0.3 mm, the distance between the beam through apertures 3*a* of the shadow mask 3 becomes too large. This decreases resolution of the color monitor.

When the vertical pitch PVt of the beam through apertures formed at the end portion of the shorter axis of the shadow mask increases less than 4% of the vertical pitch of the central portion, ITC productivity is deteriorated because a space between neighboring apertures of the shadow mask becomes too small as in the case where the vertical pitch is smaller than 0.2 mm. When the vertical pitch PVt of the end portion of the shorter axis of the shadow mask increases more than 12% of the vertical pitch of the central portion thereof, resolution is decreased because the distance between the beam through apertures of the shadow mask becomes too large as in the case where the vertical pitch is larger than 0.3 mm.

The shadow mask is a roughly rectangular shape having longer and shorter axes and having a plurality of beam through apertures 3*a*. The vertical pitch of the beam through apertures 3*a* is between 0.15 mm and 0.35 mm. It is preferable that the vertical pitch of the beam through apertures increases as it goes from the central portion to the corner portion of the shadow mask and the vertical pitch PVc of the beam through apertures formed at the corner portion of the shadow mask increases 3%~10% of the vertical pitch PVo of the beam through apertures placed at the central portion thereof.

When the vertical pitch PVc of the beam through apertures formed at the corner portion of the shadow mask increases less than 3% or more than 10% of the vertical pitch of the central portion of the shadow mask, there occurs the same problem as that occurring when the vertical pitch PVt of the beam through apertures formed at the end portion of the shorter axis of the shadow mask increases less than 4% or more than 12% of the vertical pitch of the central portion of the shadow mask.

Preferably, the vertical pitch PV of the beam through apertures 3*a* of the shadow mask is formed such that it decreases as it goes from the center PVo to the end portion PVe of the longer axis of the shadow mask.

Meanwhile, the horizontal pitch PH of the shadow mask satisfies the following expression (3).

$$0.3\ \text{mm} \leqq PH \leqq 0.6\ \text{mm} \quad (3)$$

When the horizontal pitch PH is smaller than 0.3 mm, the distance between neighboring beam through apertures 3*a* of the shadow mask becomes narrow to reduce electron beam margin, inversely affecting purity characteristic. When it is larger than 0.6 mm, the distance between the beam through apertures becomes too wide, deteriorating the resolution of the CRT.

Preferably, the horizontal pitch PH of the beam through apertures 3 increases as it goes from the central portion PHo to the end portion PHe of the longer axis of the shadow mask.

The electron beams 6 pass through the beam through apertures 3*a* of the shadow mask 3 to be scanned on the phosphors R, G and B formed on the screen. The horizontal pitch SP and vertical pitch SW of the fluorescent screen depend on the horizontal pitch PH and vertical pitch PV between adjacent beam through apertures of the shadow mask. Accordingly, it is preferable that the relationship between the horizontal pitch SP of the fluorescent screen and the horizontal pitch PH of the beam through apertures 3*a* of the shadow mask satisfies the following expression (4).

$$PH \leqq SP \leqq 1.1PH \quad (4)$$

Furthermore, the vertical pitch PV of the shadow mask according to the present invention can be applied to a flat type color CRT including the panel 1 having an substantially flat outer surface and an curved inner surface, the funnel 2 coupled to the panel 1, the electron gun housed within the neck portion of the funnel for emitting the electron beams 6 toward the fluorescent screen 4, and the shadow mask 3 formed on the inner surface of the panel having a predetermined distance from the fluorescent screen 4 for carrying out color selection. The shadow mask of the present invention is designed to have the aforementioned vertical pitch so as to prevent occurrence of the moire phenomenon and improve purity characteristic.

While the conventional beam through apertures 3*a* are slot-shaped or dot-shaped, the shape of the beam through apertures of the present invention is completely round or close to completely round. Preferably, the vertical pitch Pvo of the beam through apertures 3*a* is larger than or identical to 0.24 mm and smaller than or identical to 0.28 at the central portion of the shadow mask.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

According to the present invention, the vertical pitch between adjacent beam through apertures of the shadow mask increases as it goes from the central portion to the end portion of the shorter axis of the shadow mask and it increases as it goes from the central portion to the corner portion of the shadow mask, thereby satisfying purity characteristic as well as moire characteristic.

What is claimed is:

1. A color cathode-ray tube including a panel having a fluorescent screen formed on the inner surface thereof, a funnel coupled to the panel, an electron gun mounted into a neck portion of the funnel for emitting electron beams toward the fluorescent screen, and a shadow mask mounted on the fluorescent screen formed on the inner surface of the panel and having a predetermined distance from the fluorescent screen for carrying out the color selection, wherein the shadow mask has a substantially rectangular shape containing a longer axis and a shorter axis and including a plurality of beam-through apertures and a vertical pitch of the beam-through apertures is between 0.15 mm and 0.35 mm;

the vertical pitch of the beam-through apertures increases as it goes from a central portion to an end portion of the shorter axis of the shadow mask;

the vertical pitch of the beam-through apertures formed at the central portion of the shadow mask is called PVo, and satisfies the following expression:

$$0.2\ \text{mm} \leqq PVo \leqq 0.3\ \text{mm};\ \text{and}$$

the vertical pitch of the beam-through apertures formed at the end portion of the shorter axis of the shadow mask is called PVt and the following expression is satisfied:

$$1.04\ PVo \leqq PVt \leqq 1.12\ PVo.$$

2. The color cathode-ray tube as claimed in claim 1, wherein the vertical pitch of the beam-through apertures increases as it goes along the diagonal direction from the central portion to the corner portion of the shadow mask.

3. The color cathode-ray tube as claimed in claim 2, wherein, when the vertical pitch of the beam-through apertures formed at the corner portion of the shadow mask is called PVc the following expression is satisfied:

$$1.03\ PVo \leqq PVc \leqq 1.1\ PVo.$$

4. The color cathode-ray tube as claimed in claim 2, wherein when a horizontal pitch of the beam-through apertures is called PH, it satisfies the following expression:

$$0.3\ \text{mm} \leqq PH \leqq 0.6\ \text{mm}.$$

5. The color cathode-ray tube as claimed in claim 2, wherein a horizontal pitch of the beam-through apertures increases as it goes from the central portion to the end portion of the longer axis of the shadow mask.

6. The color cathode-ray tube as claimed in claim 5, wherein the horizontal pitch of the beam-through apertures increases as it goes from the central portion to the end portion in the shorter axis direction or in a diagonal direction.

7. The color cathode-ray tube as claimed in claim 2, wherein when a horizontal pitch of a fluorescent material of the screen is called SP and the horizontal pitch of the shadow mask is called PH, they satisfy the following expression:

$$PH \leqq SP \leqq 1.1\ PH.$$

8. The color cathode-ray tube as claimed in claim 2, wherein the shape of the beam-through apertures is circular or oval.

9. The color cathode-ray tube as claimed in claim 2, wherein $$0.24\ \text{mm} \leqq PVo \leqq 0.28\ \text{mm}.$$

10. The color cathode-ray tube as claimed in claim 1, wherein the vertical pitch of the beam-through apertures decreases as it goes from the central portion to the end portion of the longer axis of the shadow mask.

11. The color cathode-ray tube as claimed in claim 1, wherein when a horizontal pitch of the beam-through apertures is called PH, it satisfies the following expression:

$$0.3\ \text{mm} \leqq PH \leqq 0.6\ \text{mm}.$$

12. The color cathode-ray tube as claimed in claim 11, wherein when a horizontal pitch of a fluorescent material of the screen is called SP and the horizontal pitch of the shadow mask is called PH, they satisfy the following expression:

$$PH \leqq SP \leqq 1.1\ PH.$$

13. The color cathode-ray tube as claimed in claim 1, wherein a horizontal pitch of the beam-through apertures increases as it goes from the central portion to the end portion of the longer axis of the shadow mask.

14. The color cathode-ray tube as claimed in claim 13, wherein when a horizontal pitch of the screen is called SP and the horizontal pitch of the shadow mask is called PH, they satisfy the following expression:

$$PH \leqq SP \leqq 1.1\ PH.$$

15. The color cathode-ray tube as claimed in claim 13, wherein the horizontal pitch of the beam-through apertures increases as it goes from the central portion to the end portion in the shorter axis direction or in a diagonal direction.

16. The color cathode-ray tube as claimed in claim 1, wherein when a horizontal pitch of a fluorescent material of the screen is called SP and the horizontal pitch of the shadow mask is called PH, they satisfy the following expression:

$$PH \leqq SP \leqq 1.1\ PH.$$

17. The color cathode-ray tube as claimed in claim 1, wherein the panel has a substantially flat outer surface and a curved inner surface.

18. The color cathode-ray tube as claimed in claim 1, wherein the shape of the beam-through apertures is circular or oval.

19. The color cathode-ray tube as claimed in claim 1, wherein, $$0.24\ \text{mm} \leqq PVo \leqq 0.28\ \text{mm}.$$

20. A color cathode-ray tube including a panel having a fluorescent screen formed on the inner surface thereof, a funnel coupled to the panel, and electron gun mounted into a neck portion of the funnel for emitting electron beams toward the fluorescent screen, and a shadow mask mounted on the fluorescent screen formed on the inner surface of the panel and having a predetermined distance from the fluorescent screen for carrying out color selection, wherein the shadow mask has a substantially rectangular shape containing a longer axis and a shorter axis and including a plurality of beam-through apertures, a vertical pitch of the beam-through apertures is between 0.15 mm and 0.35 mm;

the vertical pitch of the beam-through apertures increases as it goes along a diagonal direction from a central portion to the corner portion of the shadow mask;

the vertical pitch of the beam-through apertures formed at the central portion of the shadow mask is called PVo, and satisfies the following expression:

$$0.2\ \text{mm} \leqq PVo \leqq 0.3\ \text{mm}; \text{ and}$$

the vertical pitch of the beam-through apertures formed at corner portion of the shadow mask is called PVc and the following expression is satisfied:

$$1.03\ PVo \leqq PVc \leqq 1.1\ PVo.$$

21. The color cathode-ray tube as claimed in claim 20, wherein the vertical pitch of the beam-through apertures decreases as it goes from the central portion to the end portion of the longer axis of the shadow mask.

22. The color cathode-ray tube as claimed in claim 20, wherein when a horizontal pitch of the beam-through apertures is called PH, it satisfies the following expression:

$$0.3\ \text{mm} \leqq PH \leqq 0.6\ \text{mm}.$$

23. The color cathode-ray tube as claimed in claim 20, wherein a horizontal pitch of the beam-through apertures increases as it goes from the central portion to the end portion of the longer axis of the shadow mask.

24. The color cathode-ray tube as claimed in claim 20, wherein when a horizontal pitch of a fluorescent material of the screen is called SP and the horizontal pitch of the shadow mask is called PH, they satisfy the following expression:

$$PH \leqq SP \leqq 1.1\ PH.$$

25. The color cathode-ray tube as claimed in claim 20, wherein the panel has a substantially flat outer surface and a curved inner surface.

26. The color cathode-ray tube as claimed in claim 20, wherein the shape of the beam-through apertures is circular or oval.

27. The color cathode-ray tube as claimed in claim 20, wherein, $$0.24\ \text{mm} \leqq PVo \leqq 0.28\ \text{mm}.$$

28. A color cathode-ray tube including a panel having a fluorescent screen formed on the inner surface thereof, a funnel coupled to the panel, an electron gun mounted into a neck portion of the funnel for emitting electron beams toward the fluorescent screen, and a shadow mask mounted on the fluorescent screen formed on the inner surface of the panel and having a predetermined distance from the fluorescent screen for carrying out the color selection, wherein the shadow mask has a substantially rectangular shape containing a longer axis and a shorter axis and including a plurality of beam-through apertures, a vertical pitch of the beam-through apertures being between 0.15 mm and 0.35 mm;

the vertical pitch of the beam-through apertures formed at a central portion of the shadow mask is smaller than the vertical pitch of the beam-through apertures formed at an end portion of the shorter axis of the shadow mask, the vertical pitch of the beam-through apertures formed at the central portion of the shadow mask is smaller than the vertical pitch of the beam-through apertures formed at a corner portion of the shadow mask;

the vertical pitch of the beam-through apertures formed at the center portion of the shadow mask is called PVo, and satisfies the following expression:

$$0.2\ \text{mm} \leqq PVo \leqq 0.3\ \text{mm}; \text{ and}$$

the vertical pitch of the beam-through apertures formed at the end portion of the shorter axis of the shadow mask is called PVt and the following expression is satisfied:

$$1.04\ PVo \leqq PVt \leqq 1.12\ PVo.$$

29. The color cathode-ray tube as claimed in claim 28, wherein the vertical pitch of the beam-through apertures formed at the central portion of the shadow mask is larger than the vertical pitch of the beam-through apertures formed at the end portion of the longer axis of the shadow mask.

30. The color cathode-ray tube as claimed in claim 28, wherein the vertical pitch of the beam-through apertures formed at the end portion of the longer axis of the shadow mask is smaller than the vertical pitch of the beam-through apertures formed at the corner portion of the shadow mask.

* * * * *